US007268793B2

(12) United States Patent
Lee

(10) Patent No.: US 7,268,793 B2
(45) Date of Patent: Sep. 11, 2007

(54) DEVICE FOR ARRAYING A THERMAL PRINTER HEAD FOR USE IN A THERMAL PRINTER

(75) Inventor: Hong Gil Lee, Suwon (KR)

(73) Assignee: Shin Heung Precision, Ltd. (KR)

( * ) Notice: Subject to any disclaimer, the term of this patent is extended or adjusted under 35 U.S.C. 154(b) by 233 days.

(21) Appl. No.: 11/079,188

(22) Filed: Mar. 15, 2005

(65) Prior Publication Data

US 2005/0212898 A1 Sep. 29, 2005

(30) Foreign Application Priority Data

Mar. 19, 2004 (KR) ..... 10-2004-0018898

(51) Int. Cl.
*B41J 2/325* (2006.01)

(52) U.S. Cl. ..... 347/222

(58) Field of Classification Search ..... 347/222, 347/220, 219, 218, 197; 400/120.16
See application file for complete search history.

(56) References Cited

U.S. PATENT DOCUMENTS 4,838,713 A * 6/1989 Kunimitsu et al. .... 400/120.16
5,898,452 A * 4/1999 Sasaki et al. ..... 347/219
2001/0022609 A1* 9/2001 Suzuki ..... 347/218

* cited by examiner

*Primary Examiner*—K. Feggins
(74) *Attorney, Agent, or Firm*—Akerman Senterfitt; Jean C. Edwards, Esq.

(57) ABSTRACT

A device for arraying a thermal printer head for use in a thermal printer is provided. The thermal printer includes a thermal printer head which is installed on a main frame to print on a sheet of paper and a transfer roller which transfers the sheet of paper at the state where the transfer roller is closely attached to the thermal printer head. The thermal printer head arraying device includes head arraying units that are disposed in either side wall of the main frame, respectively, to uniformly array the thermal printer head on the transfer roller. A head open unit is provided having a head open lever and an open lever lock that isolate the thermal printer head from the transfer roller when the thermal printer is internally repaired or sheets of paper are exchanged.

6 Claims, 9 Drawing Sheets

DEVICE FOR ARRAYING A THERMAL PRINTER HEAD FOR USE IN A THERMAL PRINTER

BACKGROUND OF THE INVENTION

1. Field of the Invention

The present invention relates to a device for arraying a thermal printer head for use in a thermal printer, and more particularly, to a thermal printer head arraying device for use in a thermal printer which is incorporated in a cash register, in which the overall surface of a thermal printer head uniformly contacts the overall surface of a transfer roller to thereby have the thermal printer head smoothly perform a printing work, to relatively reduce the number of components in comparison with the conventional art to save a production cost, and to make the size of the product compact through a simplified structure and an assembly process simplified.

2. Description of the Related Art

As is well known, devices which can issue receipts such as an electronic cash register (ECR), a POS terminal, and a credit card terminal are widely used in convenience stores, supermarkets, restaurants, and department stores, in order to perform functions such as details of transactions, calculation of sales amount, issuance of receipts.

The cash register is a very useful device for managing sales and inventory, which processes various kinds of data accompanied by sales of products, and informs a user of the processed result, to thereby help the user to smoothly manage information.

The cash register is generally incorporated as a set including a printer, a keyboard, a display, a cash drawer, etc. However, according to enlargement and specialization of stores, owners of the stores need management of products, customers, and employees through systemization and network. Thus, demand of POS systems increases gradually.

In addition, peripheral devices which are used in the cash register and the POS system become modular. a small-sized printer which can be incorporated in a set such as a cash register, a POS terminal, and a credit card terminal as a peripheral device, is used as a device for printing a receipt which is issued from the set.

The small-sized printer is classified into a dot printer and a thermal printer according to a printing type. The dot printer can print a receipt containing details of transactions on a sheet of paper in which an impact is applied to a circulating ribbon. The thermal printer can print a receipt containing details of transactions on a sheet of paper using a thermal heat. The thermal printer having almost little noise or vibration is recently widely used.

FIG. 1 is a front view showing an example of a conventional thermal printer for use in a conventional cash register, and FIG. 2 is a side view showing an example of a conventional thermal printer for use in a conventional cash register.

As shown in FIGS. 1 and 2, a conventional thermal printer used in a conventional cash register includes a frame 100 having a predetermined internal space, a transfer roller 120 which is combined with transfer roller mounting holes (not shown) which are formed in both sides of the frame 100, and is rotatably installed to transfer a sheet of paper 110, a guider 130 for guiding the sheet of paper 110, a thermal printer head 140 which performs printing on the sheet of paper 100, a driving motor 150 which provides the transfer roller 120 with a rotational force to make the transfer roller 120 rotate, a speed reduction gear 210 which is installed between the transfer roller 120 and the driving motor 150 and reduces the rotational force of the driving motor 150 to then transfer the reduced rotational force to the transfer roller 120, a shaft 160 which is coupled with shaft mounting holes which are formed in both sides of the frame 100, a first bracket 170 to the upper side of which the thermal printer head 140 is fixed and with the lower side of which the shaft 160 is rotatably fitted, a second bracket 180 which is rotatably coupled with the shaft 160 and maintains a predetermined gap from the first bracket 170, a spring 190 which is interposed between the first and second brackets 170 and 180, and a head open lever 200 which rotates the first and second brackets 170 and 180 to isolate the thermal printer head 140 from the transfer roller 120 by a predetermined distance.

In the case of the conventional thermal printer as shown in FIGS. 1 and 2, the thermal printer head 140 should be isolated from the transfer roller 120 in order to repair the thermal printer or insert sheets of paper 110, at the state where the thermal printer head 140 contacts the transfer roller 120. In this case, when the head open lever 200 is turned in a predetermined direction, for example, clockwise, the second bracket 180 which has been supported by the head open lever 200 is elastically turned by the spring 190 around the shaft 160.

Simultaneously, the first bracket 170 to which the thermal printer head 140 is fixed is turned around the shaft 160, and thus the thermal printer head 140 is isolated from the transfer roller 120.

Meanwhile, in the case that the isolated thermal printer head 140 is made to contact the transfer roller 120 after having completed internal repair or exchange of sheets of paper at the state where the thermal printer head 140 has been isolated from the transfer roller 120, the above-described operation should be performed in reverse sequence. That is, if the head open lever 200 is turned counterclockwise, the second bracket 180 is a little turned clockwise around the shaft 160 by the eccentric rotation of the head open lever 200.

The spring 190 is pressurized by rotation of the second bracket 180. In this case, the first bracket 170 is a little turned elastically clockwise by pressurizing the spring 190.

Accordingly, the thermal printer head 140 which is fixedly installed in the upper side of the first bracket 170 narrows the gap isolated from the transfer roller 120 and contacts the transfer roller 120 elastically. As a result, a sheet of paper 110 which is placed between the transfer roller 120 and the thermal printer head 140 is smoothly transferred by the transfer roller 120. Simultaneously, the thermal printer head 140 performs printing on the sheet of paper 110.

However, in the case of the above-described conventional thermal printer, it is very difficult to accurately mount the shaft 160 and the transfer roller 120 in equilibrium. Accordingly, the overall surface of the thermal printer head 140 does not contact the overall surface of the transfer roller 120 uniformly at the process of making the thermal printer head 140 contact the transfer roller 120. That is, one side of the thermal printer head 140 contacts the transfer roller 120 and the other side thereof comes off the transfer roller 120. As a result, printing is not smoothly performed.

In addition, an operational structure of the head open lever 200 for isolating the thermal printer head 140 from the transfer roller 120 by a predetermined distance is complicated somewhat. Accordingly, the number of components becomes large and thus the number of assembly processes increases. This is one of factors which prevent a product from being compact.

SUMMARY OF THE INVENTION

To solve the above problems of the conventional art, it is an object of the present invention to provide a device for arraying a thermal printer head for use in a thermal printer in which the overall surface of a thermal printer head uniformly contacts the overall surface of a transfer roller at the process that the thermal printer head contacts the transfer roller to thereby have the thermal printer head smoothly perform a printing work, to relatively reduce the number of components in comparison with the conventional art to save a production cost, and to make the size of the product compact through a simplified structure and an assembly process simplified.

It is another object of the present invention to provide a thermal printer head arraying device for use in a thermal printer, further including a head open unit in one side of a thermal printer head, in which the thermal printer head can be isolated more easily from the transfer roller even with an internal repair or exchange of a sheet of paper such as removal of paper jam at the state where the thermal printer head has contacted the transfer roller.

To accomplish the above object of the present invention, there is provided a device for arraying a thermal printer head for use in a thermal printer having a thermal printer head which is installed on a main frame to print details of transactions on a sheet of paper and a transfer roller which transfers the sheet of paper at the state where the transfer roller is closely attached to the thermal printer head, the thermal printer head arraying device comprising: head arraying units (A) which are disposed in either side wall of the main frame, respectively, wherein each head arraying unit (A) has an eccentric cam which is connected with a rotational shaft on either side surface of the thermal printer head, in which a spring stationary unit is extended from one side of the eccentric cam; and a spring which provides the eccentric cam with an elastic force and thus one end of which is fixedly connected with a side wall of the main frame and the other end of which is connected with the spring stationary unit of the eccentric cam, so as to closely uniformly array the thermal printer head on the transfer roller.

The thermal printer head arraying device also comprises a head open unit (B) which is installed on a side wall of the main frame, wherein the head open unit (B) comprises: a head open lever which is extended in opposition to the spring stationary unit from one eccentric cam among a plurality of eccentric cams which are connected with both sides of the thermal printer head through the rotational shaft; and an open lever lock whose one end is horizontally installed on the side wall of the main frame and other end becomes a free end and which has a structure of rotating with the free end, so that the eccentric cam rotates through an area contact to the head open lever, whereby the thermal printer head can be isolated from the transfer roller when the thermal printer is internally repaired or sheets of paper are exchanged.

It is preferable that a cover protrusion which limits a lateral movement of the head open lever is integrally formed toward the rear surface of one end of the open lever lock which contacts the head open lever on a surface-to-surface basis.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

A thermal printer head arraying device according to a preferred embodiment of the present invention will be described with reference to the accompanying drawings.

Figure 1:
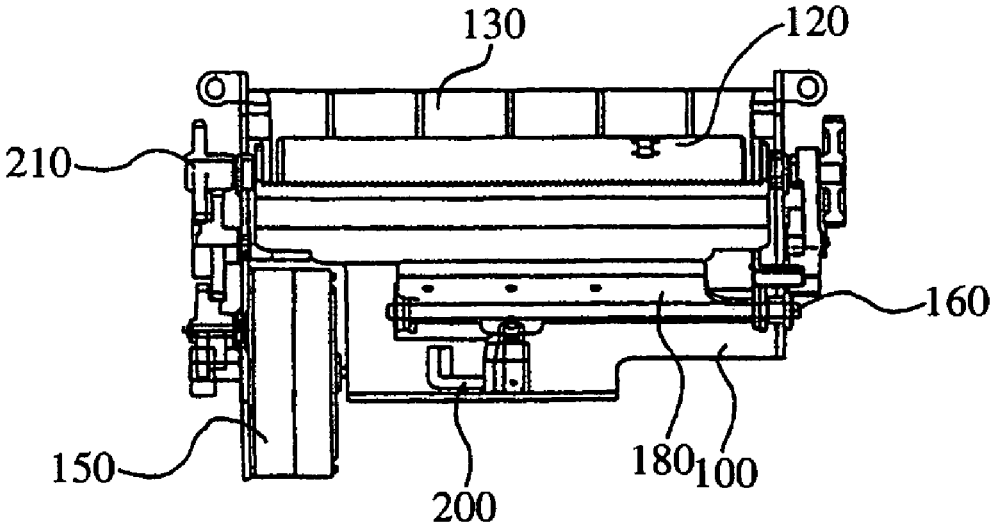
FIG. 1 (PRIOR ART)
FIG. 1 is a front view showing an example of a conventional thermal printer for use in a conventional cash register.
Figure 2:
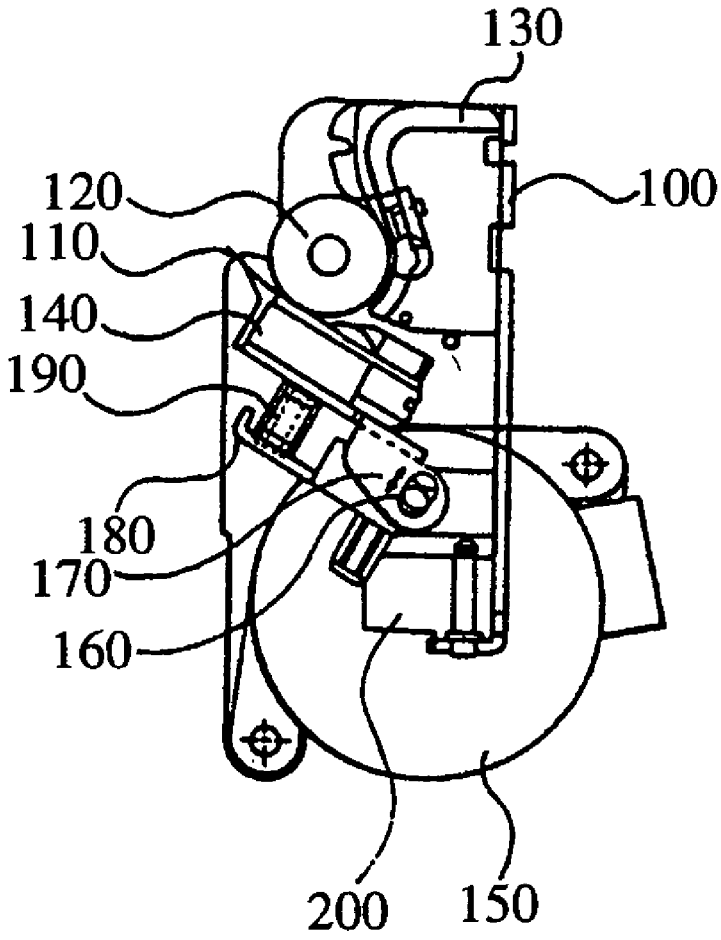
FIG. 2 (PRIOR ART)
FIG. 2 is a side view showing an example of a conventional thermal printer for use in a conventional cash register.
Figure 3:
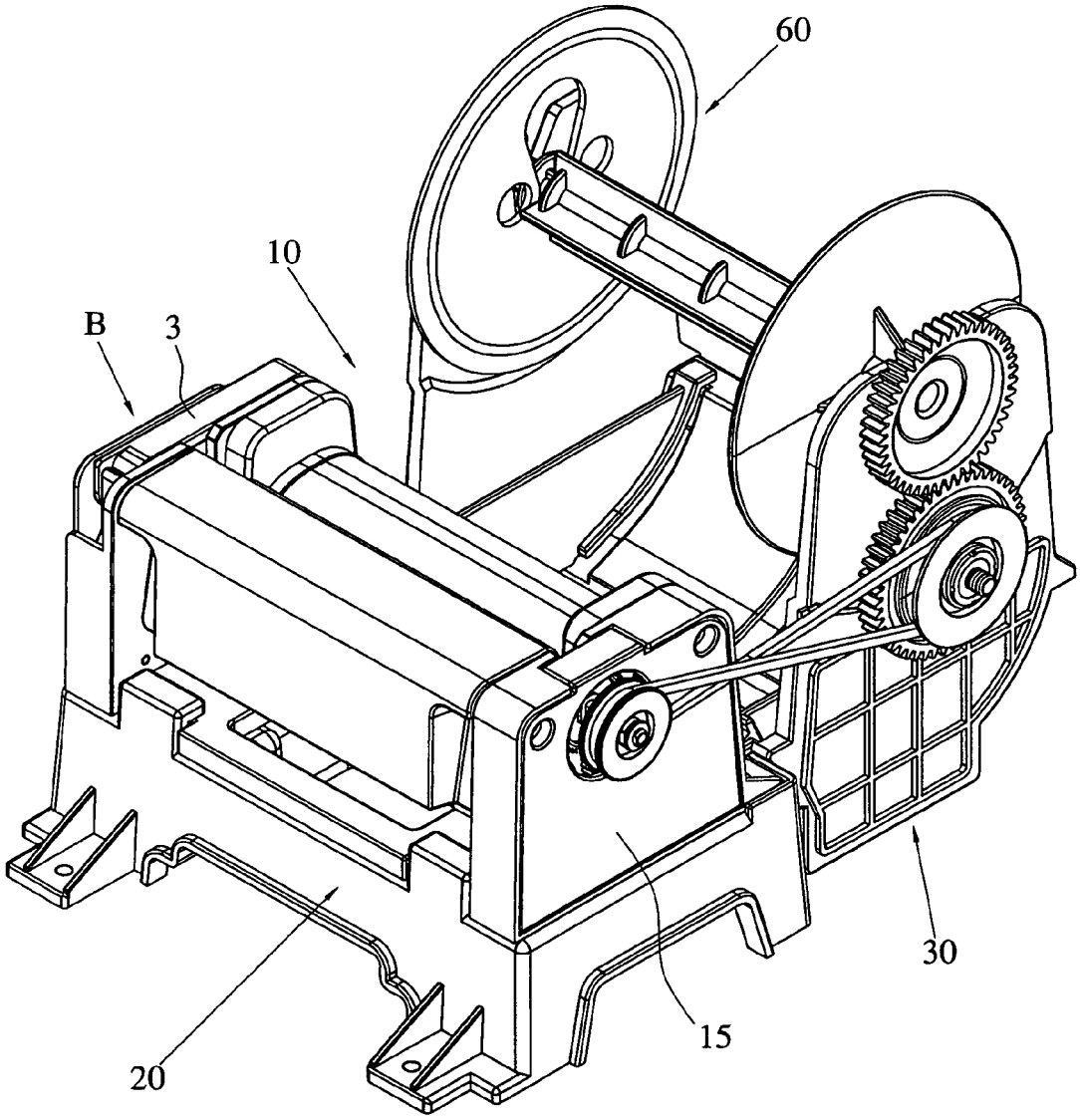
FIG. 3 is a perspective view showing a thermal printer according to an embodiment of the present invention.
Figure 4:
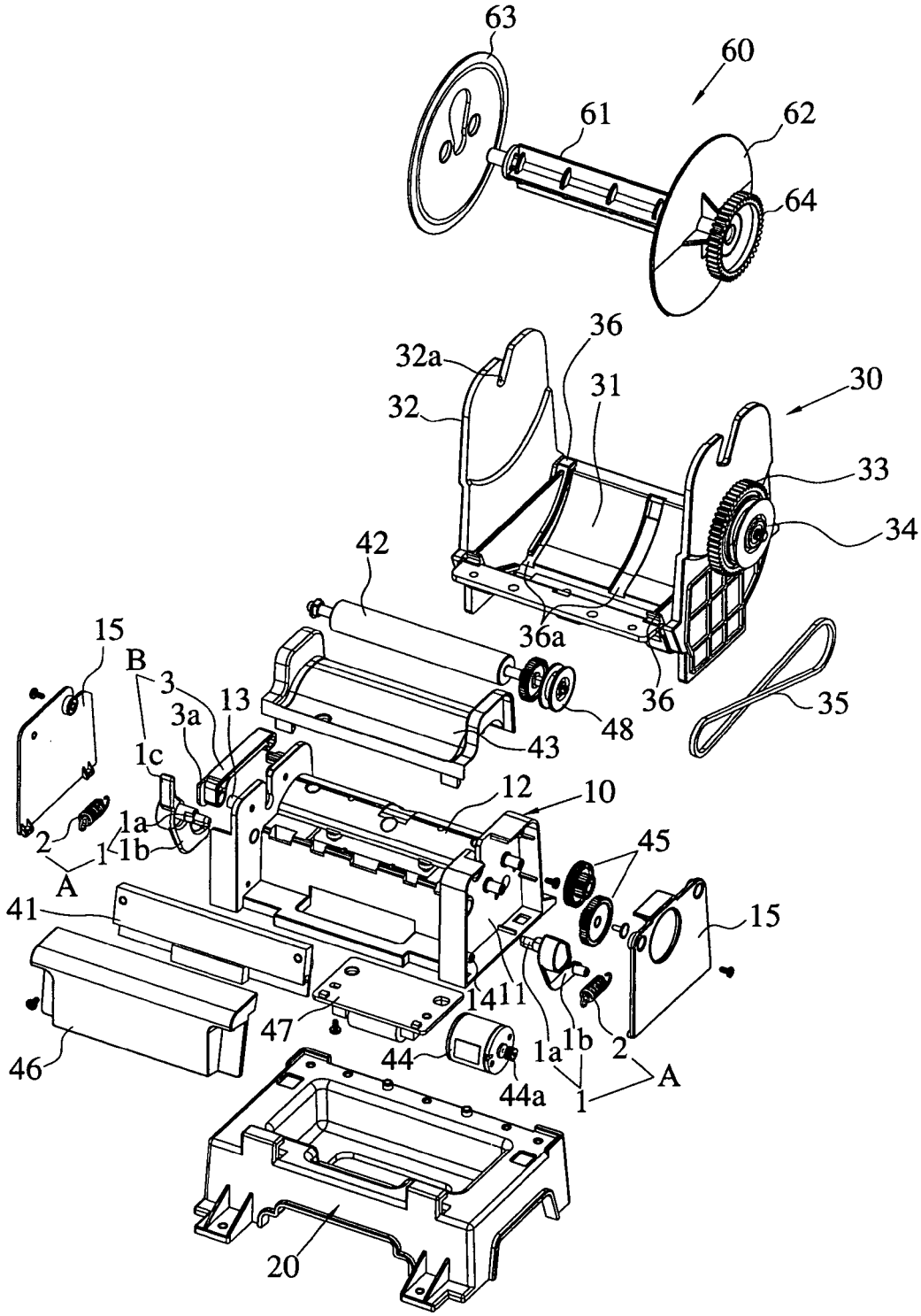
FIG. 4 is an explosive perspective view showing the thermal printer shown in FIG. 3.
Figure 5:
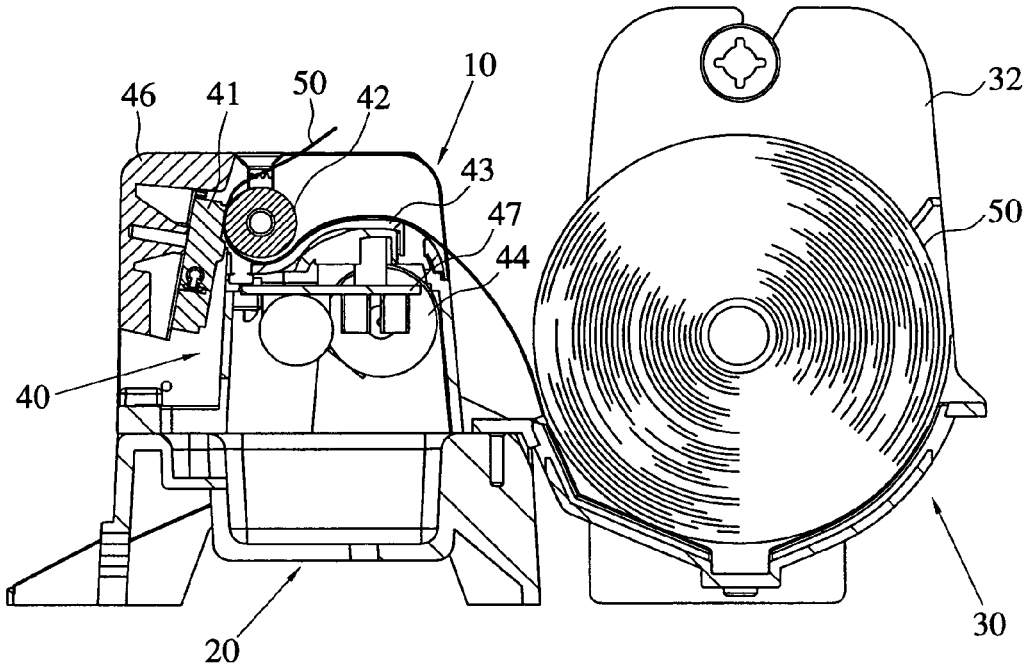
FIG. 5 is a cross-sectional view showing essential elements of the thermal printer according to the present invention.

FIG. 3 is a perspective view showing a thermal printer according to an embodiment of the present invention. FIG. 4 is an explosive perspective view showing the thermal printer shown in FIG. 3. FIG. 5 is a cross-sectional view showing essential elements of the thermal printer according to the present invention.

Figure 6:
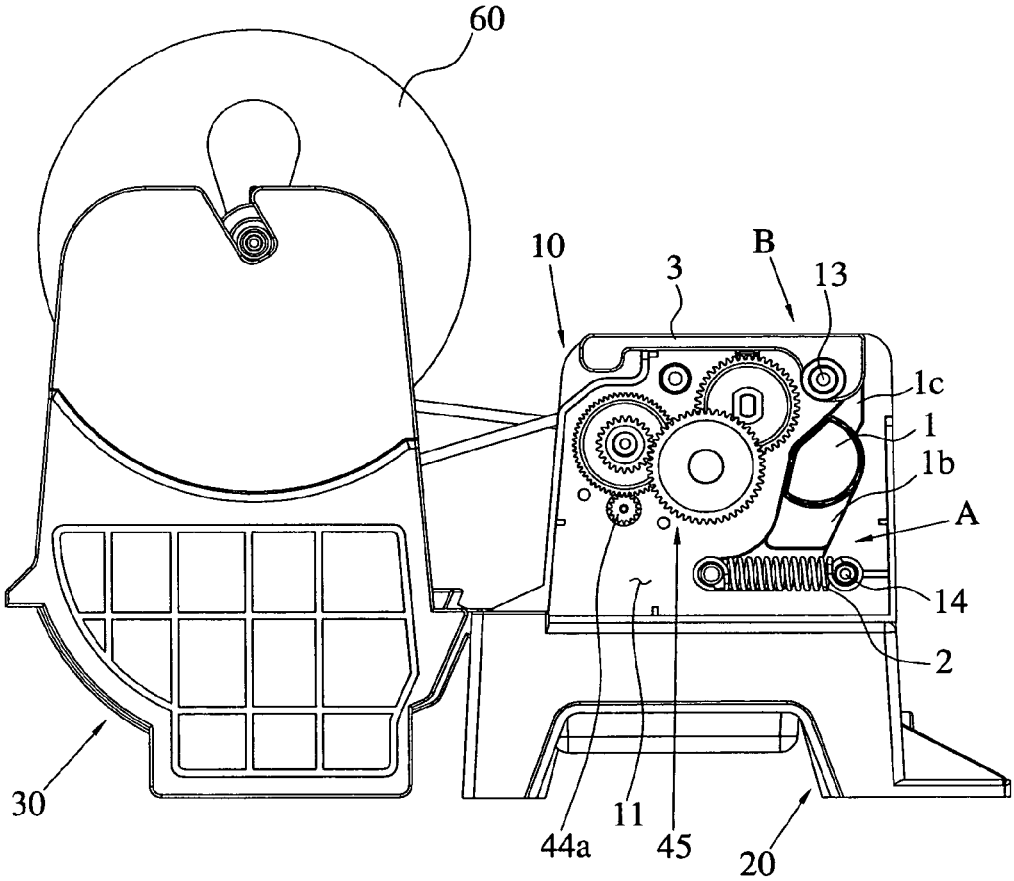
FIGS. 6 and 7 are left-hand and right-hand side views, respectively showing the essential elements of the thermal printer according to the present invention.
Figure 7:
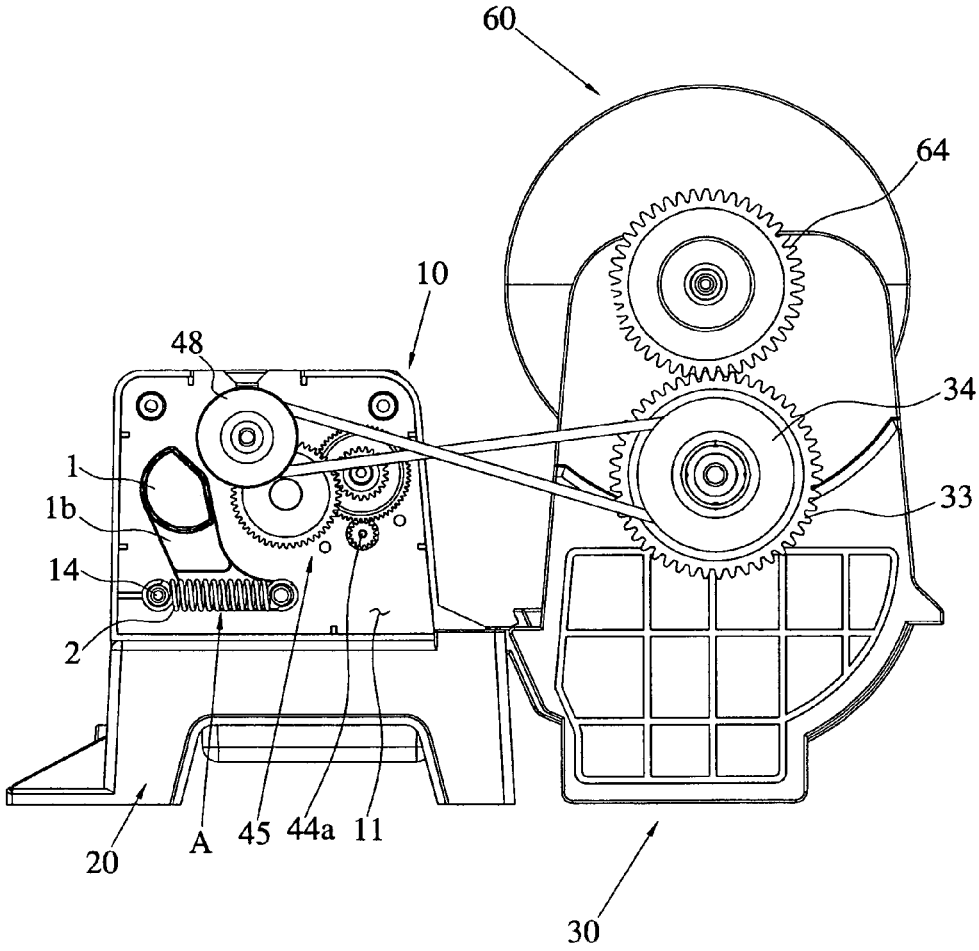
Figure 8:
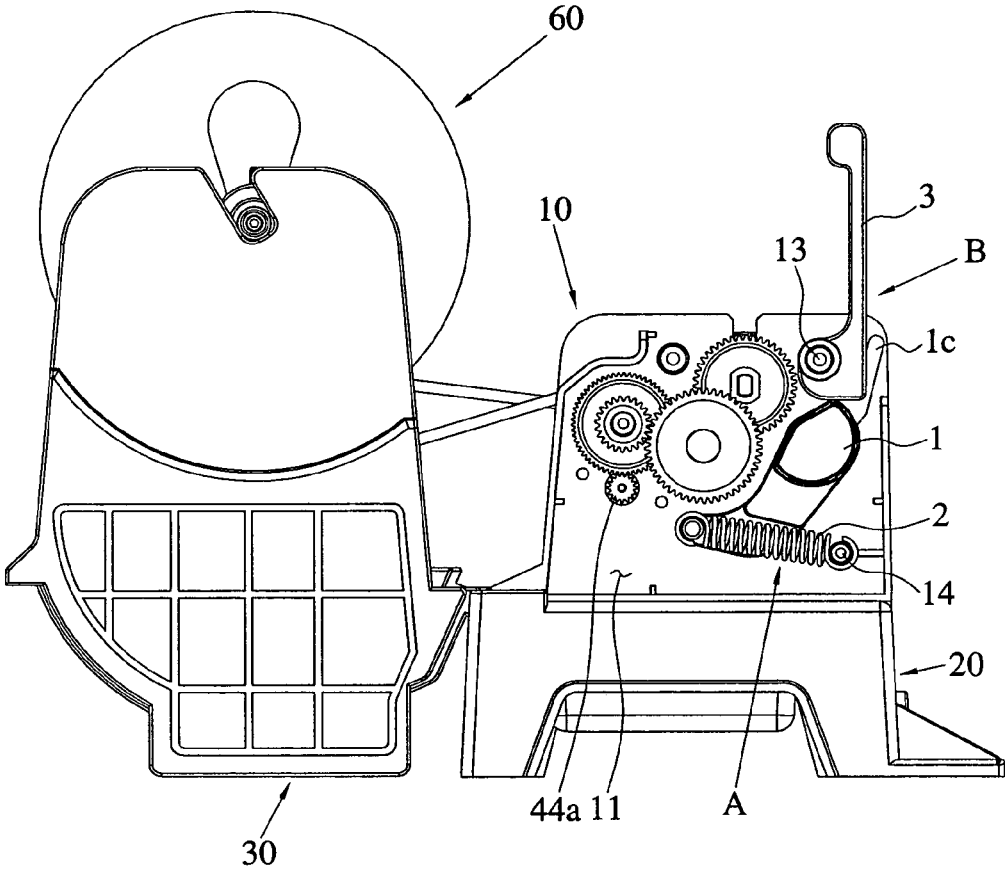
FIG. 8 is a side view showing an operational state of a head open unit according to the present invention.
Figure 9:
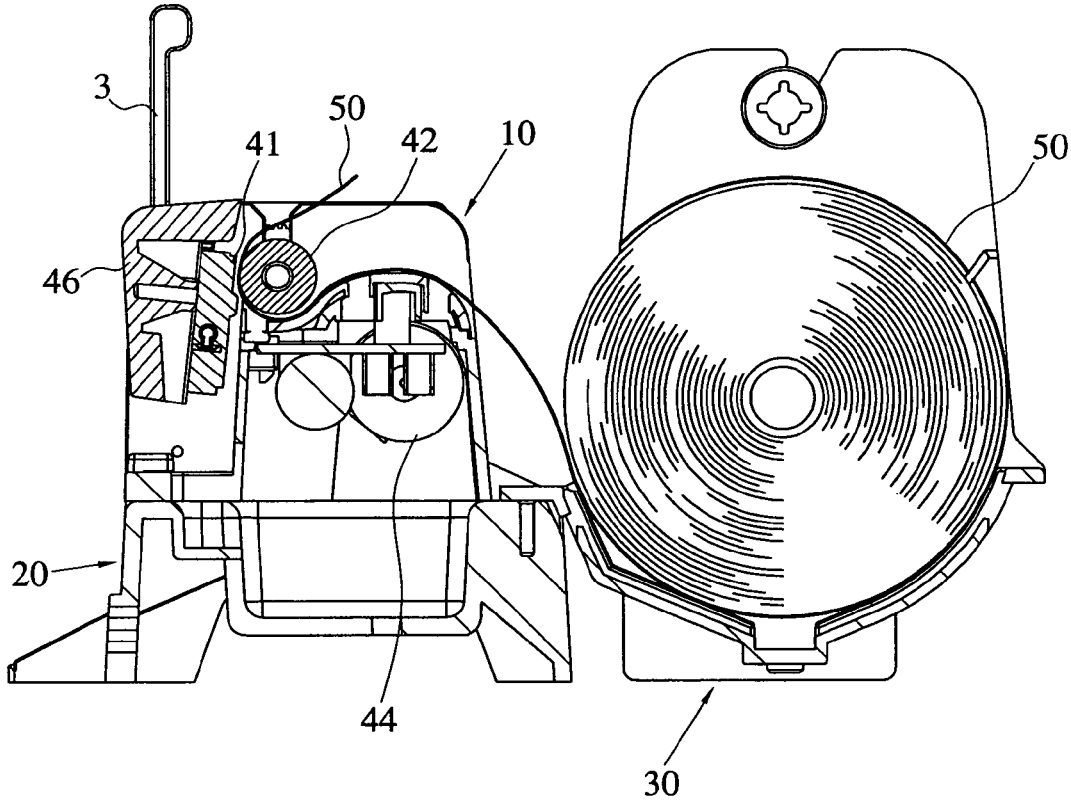
FIG. 9 is a cross-sectional view showing a state where the thermal printer head according to the present invention is isolated from the transfer roller according to an operation of the head open unit.

Also, FIGS. 6 and 7 are left-hand and right-hand side views, respectively showing the essential elements of the thermal printer according to the present invention. FIG. 8 is a side view showing an operational state of a head open unit according to the present invention. FIG. 9 is a cross-sectional view showing a state where the thermal printer head according to the present invention is isolated from the transfer roller according to an operation of the head open unit.

As shown in FIGS. 3 through 5, a thermal printer which is incorporated in a cash register includes a main frame 10 where various components are mounted, a printer holder 20 where the main frame 10 is securely mounted, a paper holder 30 which is connected with and installed in the printer holder 20, and placed in front of the main frame 10, to thereby securely hold and feed sheets of paper, and a printer mechanism 40 which is installed on the main frame 10 to print details of transactions on a sheet of paper 50 fed from the paper holder 30.

Here, the main frame 10 is a unit which is fabricated through an injection molding work and others, and has a structure of easily installing respective components of the printer mechanism 40 so that the respective components of the printer mechanism 40 can operate smoothly with an organical relationship therebetween.

That is, a predetermined space is formed in the main frame 10 in the present invention. Accordingly, a driving motor 44 and a connection board 47 which constitutes the printer mechanism 40 are installed in the space. A curved portion 12 having a predetermined curved surface is formed in the front area of the main frame 10. A guider 43 which guides transfer of the sheet of paper 50 is attachably and detachably engaged with the curved portion 12.

A thermal printer head 41 and a transfer roller 42 which constitute the printer mechanism 40 to be described later are installed over side walls 11 positioned at both sides of the main frame 10. A speed reduction gear set 45, a head arraying unit (A) and a head open unit (B) which constitute the printer mechanism are installed on the outer circumferential surfaces of the side walls 11 positioned at both sides of the main frame 10.

Here, after the components constituting the printer mechanism 40 have been installed, lateral covers 15 are engaged with the side walls 11 positioned at both sides of the main frame 10. Accordingly, the components can be prevented from being exposed externally and protected from the external stimulation.

The printer holder 20 is fabricated in the form of a single unit through an injection molding work and others like the main frame 10, and has a structure of securely supporting and fixing the main frame 10 in which the printer holder 20 can be stationarily installed in the main frame of a cash register (not shown).

The paper holder 30 holds sheets of paper 50. The paper holder 30 is fabricated in the form of a single unit so as to be attachably and detachably engaged with the printer holder 20 in front of the main frame 10.

Here, a paper positioning stand 31 which is formed curvedly and concavely is provided in the paper holder 30 on a relationship with an external appearance of the sheet of paper. The paper positioning stand 31 is designed in relation with the width or diameter of the sheet of paper 50 which is held in the paper holder 30.

A plurality of partition lines 36*a* are formed in the paper positioning stand 31. The structure of the paper positioning stand 31 can be changed as necessary through separate partitioning plates 36 provided along the plurality of partitioning lines 36*a*.

Thus, only if sheets of paper 50 are placed on the partitioned paper positioning stand 31 according to partitioning of the partitioning plates 36, they can be placed and held in the paper holder 30.

The printer mechanism 40 includes a thermal printer head 41 which is installed on the main frame 10, to print details of transactions of products on a sheet of paper 50, a transfer roller 42 which transfers a sheet of paper 50 at the state of closely contacting the thermal printer head 41, a guider 43 which guides a sheet of paper from the paper holder 30 to the transfer roller 42, a driving motor 44 which provides the transfer roller 42 with a rotational force so as to rotate the transfer roller 42, a speed reduction gear set 45 which reduces a rotational force of the driving motor 44 and transfers the reduced rotational force to the transfer roller 42, a head arraying unit (A) including a plurality of eccentric cams 1 and springs 2 which are disposed on side walls 11 in both sides of the main frame 10 which are positioned in both side surfaces of the thermal printer head 41, a head open unit (B) which isolates the thermal printer head 41 from the transfer roller 42 by a predetermined distance, and a connection board 47 formed of a printed circuit board (PCB) which is connected and installed in order to control operations of the thermal printer head 41 and the driving motor 44.

Here, the thermal printer head 41 which performs a printing work on a sheet of paper 50 is installed in the rear side of the transfer roller 42 at the state of being isolated from or contacting the transfer roller 42 by a predetermined gap.

The thermal printer head 41 is installed over the side walls 11 in both sides of the main frame 10, and has a structure of uniformly contacting or being isolated from the transfer roller 42 by the head arraying unit (A) and the head open unit (B). Moreover, the thermal printer head 41 is installed at the state where the rear surface of the thermal printer head 41 is covered with a protection cover 46.

In addition, the speed reduction gear set 45 which is installed on the outer circumferential surface of each side wall 11 in both sides of the main frame 10 is connected with a driving shaft 44*a* of the driving motor 44 which provides a driving force at a geared engagement state, and simultaneously connected with both ends of the transfer roller 42 through a geared engagement state. Accordingly, the driving force of the driving motor 44 is transferred to the transfer roller 42.

Thus, the rotational force of the driving motor 44 is transferred to the speed reduction gear set 45. The rotational force transferred to the speed reduction gear set 45 is again transferred to the transfer roller 42. A sheet of paper 50 is transferred by the transfer roller 42 between the thermal printer head 41 and the transfer roller 42, to thereby allow the thermal printer head 41 to perform a printing work on the sheet of paper 50.

In addition, a driving pulley 48 is coupled with and installed in one end of the transfer roller 42. The driving pulley 48 constitutes a pair together with a driven pulley 34 which is integrally coupled with a driven gear 33 in the paper holder 30. A belt 35 is connected between the driving pulley 48 and the driven pulley 34 so as to transfer the driving force of the driving motor 44 to the driven gear 33 in the paper holder 30. Accordingly, a spool 60 which keeps wound sheets of paper 50 can rotate.

The spool 60 is fabricated in the form of a single unit for the purpose of winding sheets of paper 50 and keeping the wound sheets of paper 50. Here, the sheets of paper are made of photosensitively processed paper. The spool 60 has a structure that a rotational shaft 61, a stationary plate 62 and a detachable plate 63 which are installed in both ends of the rotational shaft 61, respectively, to prevent the sheet of paper 50 from seceding and support the sheet of paper 50, and an engagement gear 64, are integrally formed.

The spool 60 can rotate through the above-described power transmission process together with operation of the driving motor 44, since the engagement gear 64 is gear-engaged with the driven gear 33 which is engaged and assembled on paper holding stands 32 in the paper holder 30 at the state where the spool 60 is securely placed into grooves 32*a* of a predetermined size which are formed in the paper holding stands 32 which are mutually installed in both sides of the paper holder 30 in opposition to each other.

In the case of the thermal printer having the above-described structure, the thermal printer head arraying device includes head arraying units (A) which are configured to allow the overall surface of the thermal printer head 41 to uniformly contact the overall surface of the transfer roller 42 at the process that the thermal printer head 41 contacts the transfer roller 42, and a head open unit (B) which is configured to have the thermal printer head 41 isolated from the transfer roller 42 in order to repair the thermal printer head 41 or exchange sheets of paper at the state where the thermal printer head 41 contacts the transfer roller 42.

That is, as shown in FIGS. 6 and 7, the head arraying unit (A) has an eccentric cam 1 which is disposed in each side wall 11 in both sides of the main frame 10 which is positioned in either side surface in both sides of the thermal printer head 41 and is connected with a rotational shaft 1*a* on either side surface of the thermal printer head 41, in which a spring stationary unit 1*b* is extended from one side of the eccentric cam 1, and a spring 2 which provides the eccentric cam 1 with an elastic force and thus one end of which is fixedly connected with a fixing protrusion 14 formed in the side wall 11 of the main frame 10 and the other end of which is connected with the spring stationary unit 1*b* of the eccentric cam 1.

Here, the head arraying unit (A) is installed on each side wall 11 in both sides of the main frame 10, close to the speed reduction gear set 45, to thereby secure a rotatable space.

Also, as described above, one end of one spring 2 is connected with one end of the spring stationary unit 1*b* in one eccentric cam 1, and the other end thereof is connected and fixed to a fixing protrusion 14 formed on the side wall 11 in the main frame 10. In this state, the spring 2 generates an elastic force. Accordingly, the spring 2 provides the eccentric cam 1 connected through the rotational shaft 1*a* in either side surface of the thermal printer head 41 with the elastic force. As a result, the spring 2 plays a role of making the thermal printer head 41 contact the transfer roller 42 elastically and uniformly.

The thermal printer head arraying device also includes a head open unit (B) which is installed on a side wall of the main frame. The head open unit (B) includes a head open lever 1*c* which is extended in opposition to the spring stationary unit 1*b* from one eccentric cam 1 among a plurality of eccentric cams 1 which are connected with both sides of the thermal printer head 41 through the rotational shaft 1*a*, and an open lever lock 3 whose one end is horizontally installed on the side wall 11 of the main frame 10 and other end becomes a free end and which has a structure of rotating with the free end, so that the eccentric cam 1 rotates through an area contact to the head open lever 1*c*.

That is, one end of the open lever lock 3 is fitted with a fixing boss 13 formed on the side wall 11 in the main frame 10, and the free end of the open lever lock 3 has a structure of a handle bar shape which can be held and rotated by a user.

In addition, in the case that the open lever lock 3 is interlocked with the eccentric cam 1, the open lever lock 3 is installed in only one side wall 11 between both side walls 11 in the main frame 10. Accordingly, the eccentric cams 1 which are connected with the thermal printer head 41 through the rotational shaft 1*a* differ in structure from each other.

That is, as shown in FIG. 6, in the case of the eccentric cam 1 connected with the open lever lock 3, the head open lever 1*c* is extended in opposition to the spring stationary unit 1*b* from one eccentric cam 1 an area contact to the head open lever 1*c*, in a structure that the spring stationary unit 1*b* for connection with the spring 2 is extended.

However, as shown in FIG. 7, in the case of the eccentric cam 1 where the open lever lock 3 is not installed, the head open lever 1*c* is not necessary. Accordingly, only the spring stationary unit 1*b* for connection with the spring 2 is extended.

In addition, in the case of the open lever lock 3 formed of the handle bar, a cover protrusion 3*a* is integrally formed in the rear surface of one end of the open lever lock 3 which is fitted with the fixing boss 13. Here, the cover protrusion 3*a* blocks the side surface of the head open lever 1*c* when the head open lever 1*c* of the eccentric cam 1 is connected with the rear surface of the open lever lock 3 at a surface contact state. As a result, the cover protrusion 3*a* pays a role of restricting the lateral movement of the head open lever 1*c*.

The operation of the head arraying unit (A) and the head open unit (B) according to the present invention having the above-described structure will follow.

First, the thermal printer head 41 and the transfer roller 42 are installed over both side walls 11 in the main frame 10. The rotational shafts 1*a* of the eccentric cams 1 are penetrated from the outer side of both the side walls 11 in the main frame 10, and then fitted with and fixed to respective side surfaces of the thermal printer head 41 positioned in the inner side of the main frame 10.

Then, one end of the spring 2 is fitted with and fixed to the spring stationary unit 1*b* of the eccentric cam 1 which is disposed in each of both side surfaces of the thermal printer head 41. The other end of the spring 2 is fitted with and fixed to the fixing protrusion 14 formed in each side wall 11 in the main frame 10. As a result, the elastic force of each spring 2 is applied to the thermal printer head 41 via the eccentric cam 1 connected to either side surface of the thermal printer head 41. Thus, the overall surface of the thermal printer head 41 contacts the transfer roller 42 uniformly.

As described above, the overall surface of the thermal printer head 41 contacts the overall surface of the transfer roller 42 uniformly without having any gap and with a constant pressure. Accordingly, printing can be smoothly performed on a sheet of paper 50 which is fed between the thermal printer head 41 and the transfer roller 42.

Meanwhile, in the case that the thermal printer head 41 is isolated from the transfer roller 42 in order to remove paper jam to then replace sheets of paper 50, or to perform internal repair in the thermal printer, at the state where the thermal printer head 41 contacts the transfer roller 42, the head open unit (B) is used.

That is, as shown in FIG. 8, when a user holds the free end of the open lever lock 3 and then turns it in a predetermined direction (clockwise), that is, when the free end thereof is erected vertically toward the upper end of the side wall of the main frame 10, the head open lever 1*c* in the eccentric cam 1 which contacts the rear surface of the open lever lock 3 in a surface-to-surface form is pushed to the rear side. Accordingly, the eccentric cam 1 rotates clockwise around the rotational shaft 1*a* connected with the thermal printer head 41 and simultaneously the spring 2 connected with one end of the spring stationary unit 1*b* in the eccentric cam 1 is extended.

In particular, when the open lever lock 3 is erected vertically, the forces of reaction which is restored into an original state is generated due to an effect of the elastic restoring force of the spring 2 from the head open lever 1*c* in the eccentric cam 1 which has been pushed to the rear side. However, since the direction of the reaction forces functions in linear direction horizontally from the rear surface of the open lever lock 3 which has been fitted with the fixing boss 13, the open lever lock 3 is not rotated into the original state but maintained at the vertical state.

Thus, as shown in FIG. 9, the thermal printer head 41 which is connected through the rotational shaft 1*a* of the eccentric cam 1 is turned a little clockwise, and simultaneously isolated toward the rear side from the transfer roller 42.

Accordingly, when a user pushes the free end of the open lever lock 3 so as to return to the original state, that is, the horizontal state, after completion of the internal repair or replacement of a sheet of paper 50, the extended springs 2 are restored and the eccentric cams 1 are rotated counterclockwise to return to the original state. As a result, the thermal printer head 41 is also rotated counterclockwise to then contact the transfer roller 42.

As described above, a thermal printer head arraying device according to the present invention includes a head arraying unit having a plurality of eccentric cams and springs which are disposed on both side walls in a main frame which is positioned in both side surfaces of a thermal printer head. Accordingly, the overall surface of a thermal printer head uniformly contacts the overall surface of a transfer roller at the process that the thermal printer head contacts the transfer roller due to a spring function of a head arraying unit disposed in both side surfaces of the thermal printer head, to thereby have the thermal printer head smoothly perform a printing work.

In addition, the thermal printer head arraying device for use in a thermal printer further includes a head open unit having an open lever lock in linkage with the eccentric cams and the springs in the head arraying unit so that the thermal printer head which contacts the transfer roller can be isolated from the transfer roller since the eccentric cams are rotated. Accordingly, even with an internal repair or exchange of a sheet of paper such as removal of paper jam at the state where the thermal printer head has contacted the transfer roller, the thermal printer head can be isolated more easily from the transfer roller.

Further, the present invention includes the head arraying unit and the head open unit, to accordingly make the size of the product compact through a simplified structure and an assembly process simplified in comparison with the conventional art. Particularly, the present invention does not use first and second brackets which have been used in the conventional art, to thereby relatively reduce the number of components in comparison with the conventional art to save a production cost.

As described above, the present invention has been described with respect to a particularly preferred embodiment. However, the present invention is not limited to the above embodiments, and it is possible for one who has an ordinary skill in the art to make various modifications and variations, without departing off the spirit of the present invention.

What is claimed is:

1. A device for arraying a thermal printer head for use in a thermal printer, the thermal printer head arraying device comprising:

a frame having side walls;

a thermal printer head that is coupled to the side walls of the frame;

a transfer roller that is coupled to the side walls of the frame, the transfer roller being located proximate to the thermal printer head to releasably contact the thermal printer head;

head arraying units that are disposed on the side walls of the frame to couple the thermal printer head to both side walls of the frame, the head arraying units comprising:

an eccentric cam having a rotational shaft and a spring stationary unit, the rotational shaft being configured to protrude through the corresponding side wall of the frame and to engage the thermal printer head; and a spring that is coupled at one end to the spring stationary unit and is coupled at the other end to a corresponding side wall of the frame, wherein the head arraying units are configured to uniformly array the thermal printer head on the transfer roller.

2. The thermal printer head arraying device according to claim 1, further comprising a protection cover that is installed in the rear surface of the thermal printer head to enclose and protect the thermal printer head.

3. The thermal printer head arraying device according to claim 1, further comprising:

a head open unit that comprises:

a head open lever that is integrally formed on the eccentric cam, the head open lever extending from the eccentric cam in a direction that is opposite to the spring stationary unit;

a boss that is provided on the side wall of the frame; and an open lever lock that is pivotally secured to the boss, the open lever lock having a first end that is proximate to the boss and is configured to abut the head open lever and a second end that extends from the boss and provides a handle to pivot the open lever lock, wherein the head open unit is configured to provide a separation between the thermal printer head and the transfer roller.

4. A device for arraying a thermal printer head for use in a thermal printer having a thermal printer head which is installed on a main frame to print details of transactions on a sheet of paper and a transfer roller which transfers the sheet of paper at the state where the transfer roller is closely affached to the thermal printer head, the thermal printer head arraying device comprising:

head arraying units which are disposed in either side wall of the main frame, respectively, wherein each head arraying unit comprises:

an eccentric cam which is connected with a rotational shaft on either side surface of the thermal printer head, in which a spring stationary unit is extended from one side of the eccentric cam; and a spring which provides the eccentric cam with an elastic force and thus one end of which is fixedly connected with a side wall of the main frame and the other end of which is connected with the spring stationary unit of the eccentric cam, so as to closely uniformly array the thermal printer head on the transfer roller a head open unit which is installed on a side wall of the main frame, wherein the head open unit comprises:

a head open lever which is extended in opposition to the spring stationary unit from one eccentric cam among a plurality of eccentric cams which are connected with both sides of the thermal printer head through the rotational shaft; and an open lever lock whose one end is horizontally installed on the side wall of the main frame and other end becomes a free end and which has a structure of rotating with the free end, so that the eccentric cam rotates through an area that contacts the head open lever, whereby the thermal printer head is isolated from the transfer roller when the thermal printer is internally repaired or sheets of paper are exchanged.

5. The thermal printer head arraying device according to claim 4, further comprising a protection cover which encloses and protects the thermal printer head, the protection cover being installed in the rear surface of the thermal printer head.

6. The thermal printer head arraying device according to claim 4, further comprising a cover protrusion that is integrally formed toward the rear surface of one end of the open lever lock which contacts the head open lever on a surface-to-surface basis, the cover protrusion being configured to limit a lateral movement of the head open lever.

* * * * *